US007100714B1

(12) United States Patent
Sollami

(10) Patent No.: US 7,100,714 B1
(45) Date of Patent: Sep. 5, 2006

(54) MINE CEILING DRILL BIT AND BLADE

(75) Inventor: Phillip A. Sollami, Herrin, IL (US)

(73) Assignee: The Sollami Company

( * ) Notice: Subject to any disclaimer, the term of this patent is extended or adjusted under 35 U.S.C. 154(b) by 292 days.

(21) Appl. No.: 10/660,719

(22) Filed: Sep. 11, 2003

Related U.S. Application Data

(60) Provisional application No. 60/410,851, filed on Sep. 13, 2002.

(51) Int. Cl.
*E21B 10/36* (2006.01)

(52) U.S. Cl. ..... 175/427; 175/420.1; 408/224

(58) Field of Classification Search ..... 175/427, 175/420.1, 426; 408/223, 224, 227, 57; D15/21, D15/139
See application file for complete search history.

(56) References Cited

U.S. PATENT DOCUMENTS 3,032,129 A * 5/1962 Fletcher et al. ..... 175/320
3,163,246 A * 12/1964 Vagins et al. ..... 175/420.1
4,342,368 A * 8/1982 Denman ..... 175/420.1
4,984,944 A * 1/1991 Pennington et al. ..... 408/223
5,184,689 A * 2/1993 Sheirer et al. ..... 175/420.1
5,287,937 A 2/1994 Sollami
5,311,959 A * 5/1994 Adams ..... 175/420.1
5,458,210 A 10/1995 Sollami
6,684,968 B1 * 2/2004 Bise et al. ..... 175/427

* cited by examiner

*Primary Examiner*—Kenneth Thompson
(74) *Attorney, Agent, or Firm*—Robert L. Marsh

(57) ABSTRACT

A drill bit consists of a bit body having a forward end and a slot in the forward end to hold a hardened cutting blade. The bit body has a table near the center of the blade to reduce the speed at which the drill bores into hard material. The blade has a central slot extending into the forward end thereof such that the slot defines inner side walls and a bridge extending between the inner side walls. The bridge has sloping sides the define a central cutting edge so as to cut particles of hard material accumulating in the slot. The inner side walls intersect the leading faces of the blade and form cutting edges which further cut particles loosened at the center of the cut. Also, relief flats relieve the concentration of forces at the ends of the primary cutting edges of the blade.

13 Claims, 7 Drawing Sheets

MINE CEILING DRILL BIT AND BLADE

The applicant claims priority from his co-pending provisional application filed Sep. 13, 2002 and assigned Ser. No. 60/410,851. The present invention relates to drill bits and the blades therefore, and specifically to an improved drill bit that can limit the rate of penetration of the bit into a hard surface to thereby reduce the breakage to the blade thereof, or can be designed to maximize the rate of penetration should that be desired.

BACKGROUND OF THE INVENTION

Drill bits for boring into rock to install roof bolts in underground mines and the like, have a hardened tungsten carbide blade mounted in a slot at the distal end of a tubular bit body. The bit body has access ports that communicate with the inner bore and a vacuum is drawn through the hollow bore of the drill bit to remove fines cut by the drill. In an alternate configuration, pressurized water may be forced through the inner bore of a hollow drill bit and out the ports near the blade to cool the blade and remove dust during the cutting process.

The roof drilling machines that force such drill bits into the ceilings of mines use hydraulics to apply great force to the lower end of the bit to force the cutting end into the hard rock and other strata. Where the cutting end of the drill bit is configured to maximize the drilling rate, the forces applied to the cutting edge of the blade are also maximized, which in turn can contribute to the failure of the blade. The life expectancy of the drill bits used to drill the holes in the roofs of mines could be increased by reducing the penetration rate of a drill bit, however, there is no practical way of reducing the force which the drilling machines apply to such bits.

Another problem with existing drill bits is that the cutting blade thereof may remove chunks of rocks that may be relatively large compared to the diameters of the passageways through which those chips must move as they are drawn away from the blade. It would be desirable therefore, to provide an improved drill bit and blade which when subjected to the strong forces of a drilling machine, would have a reduced penetration rate to thereby reduce the forces on the blade such that the overall life of the drill bit and blade are extended. It would also be desirable to provide a drill bit and blade that would assist in the fragmenting of chunks of strata broken loose near the center of the blade to improve the removal thereof. These blades will cut into steel, aluminum and other hard materials.

SUMMARY OF THE INVENTION

Briefly, the present invention is embodied in a drill bit consisting of an elongate bit body having a rearward mounting end for attachment to a tubular drill steel or the like, and a forward cutting end to which a cutting blade is attached. A vacuum is drawn through the drill steel to draw particles or fines loosened by the drill bit through the inner bore of the tubular drill steel to a remote location. The forward end of the drill bit includes a slot into which the blade is brazed and at least one transverse hole extending from the outer surface of the bit body into the cylindrical inner bore thereof such that fines or particles loosened by the blade can be drawn into the bore of the drill steel.

The bit body further has a table defining a plane perpendicular to the axis of the bit body positioned adjacent a mid-portion of the blade. I have found that the provision of the table adjacent to the mid-portion of the blade causes particles broken up by the blade to gather and accumulate between the table and the forward end of the bore being cut by the blade. The gathering of particles above the table and below the forward end of the bore causes a reduction in the penetration rate at which the drill bores into the hard surface. Reducing the penetration rate causes a corresponding reduction in the forces applied against the blade, thereby reducing the rate at which the blade becomes worn and reducing the likelihood of the blade becoming fractured.

I have found that by moving the plane of the table forwardly, towards the forward cutting edge of the blades, increases the clogging effect of the cuttings and reduces the drill rate of the drill whereas moving the table rearwardly, away from the cutting on the blades reduces the clogging of the particles and increases drill rate. As an alternative, the surface area of the table can be increased to reduce drill rate, or decreased to increase drill rate. Accordingly, the position and configuration of a table at the forward end of a drill bit can be used to control the rate at which the drill bores into a hard surface when subjected to a given force to thereby optimize the drilling capabilities of the drill bit. The configuration of the table can therefore be adjusted to compensate for the force applied to the end of a drill steel by a hydraulically operated drilling machine.

In the preferred embodiment, the blade has a longitudinal axis with a cutting forward end and a rearward mounting portion for fitting into the slot of the bit body. The blade has first and second opposing cutting sides with each side extending radially from a central axis to an outer end. Each of the first and second sides also has a pair of opposing faces with a leading face of one cutting side coplanar with the trailing face of the other. At the forward end of each cutting side is a cutting surface defining a leading cutting edge and a trailing relief edge, the cutting edge of one side being aligned with the trailing edge of the other side. At the outer end of each of the cutting sides is a cutting edge that cuts the outer wall of the bore, the upper end of which intersects the forward cutting edge of the blade.

Extending axially rearward into the forward end between the cutting surfaces of the blade is a longitudinal slot, the slot forming opposing inner walls, and between the walls and at the bottom of the slot is a bridge surface extending from one wall to the other. In accordance with another feature of the invention, the parallel inner walls of the slot are not perpendicular to the surfaces of the first and second faces, but are angled with respect thereto to form an inner cutting edge at the intersection of each of the inner walls and the leading face thereof.

The invention further provides for a cutting edge along the bridge between the walls with angled surfaces extending rearwardly from opposite sides of the cutting edge. The cutting edge of the bridge and the inner cutting edges along the inner walls help cut chunks of rock and other hard material loosed by the blade so that they may be subsequently drawn by a vacuum across the sloping surfaces of the bit body to the aperture therein and into the inner bore of the drill steel for removal from the drill site. Each of the cutting sides of the blade, therefore, has a forward cutting edge, an outer end cutting edge, and an inner cutting edge with the forward cutting edge connecting with the associated outer end cutting edge and the associated inner cutting edge.

During use, axial and radial forces are generated within the body of the blade and become concentrated at the corners thereof. These inner forces can cause the rapid deterioration of the hard metal forming the cutting edge beginning from the corners thereof. I have found that the provision of a first flat at the end of the forward cutting edge where it intersects the inner wall, and a second flat at the other end of the forward cutting edge where it intersects the outer end, will disburse those forces and prevent deterioration of these cutting surfaces. The inverted V-shape of the bridge at the bottom of the slot provides minimal resistance to removing the core portion left in the center of the cut. Since the center of the rotating axis has near zero surface speed the thrust forces are reduced due to the minimal edge provided at the top of the bridge.

BRIEF DESCRIPTION OF THE DRAWINGS

A better understanding of the invention will be had after a reading of the following detailed description taken in conjunction with the accompanying drawings wherein.

DETAILED DESCRIPTION OF A PREFERRED EMBODIMENT

Figure 1:
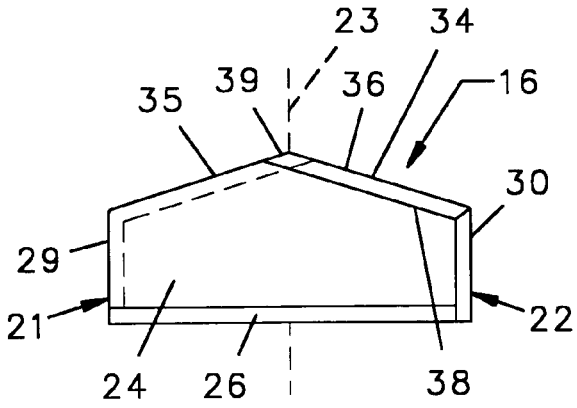
FIG.1 PRIOR ART
FIG. 1 is a side elevational view of a drill blade in accordance with the prior art.

Referring to FIGS. 1, 2, 3, and 4, a drill bit 10 in accordance with the prior art consists of a bit body 12 having a tubular rearward end 13 the inner diameter of which is sized to receive a tubular drill steel with a hexagon drive, not shown. The bit body 12 is retained to the drill steel by a clip, not shown, extending through a hole 14 near the rearward end of the bit body 12. At the forward end of the bit body is a transverse slot 15 which retains the mounting portion of a blade 16. Adjacent to the sides of a blade 16 the bit body 12 has a ramped surface 17 which leads to a notched out portion 18 that extends approximately half way down the length of the bit body and defines a generally planar surface 19. An aperture 20 in the planar surface 19 communicates with the hollow inner bore of the bit body 12 such that cuttings, removed by the blade 16 can fall across the ramp surface 17 and be drawn by a vacuum along the notched out portion 18 and through the aperture 20 and into the hollow interior thereof.

Figure 2:
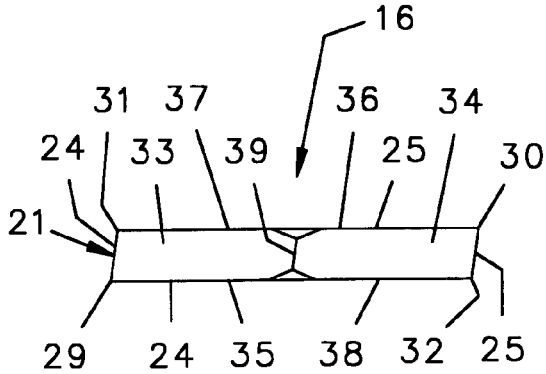
FIG.2 PRIOR ART
FIG. 2 is a top elevational view of the drill blade shown in FIG. 1.
Figure 3:
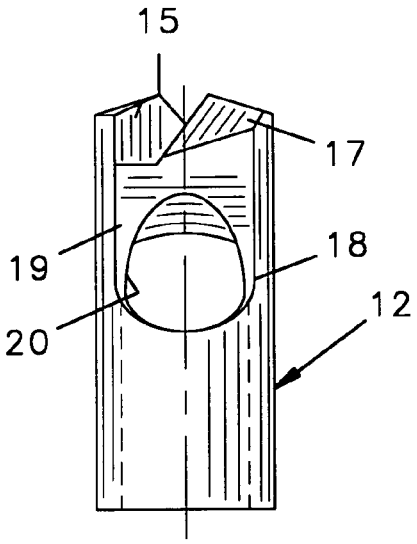
FIG.3 PRIOR ART
FIG. 3 is a side elevational view of a bit body in accordance with the prior art.
Figure 4:
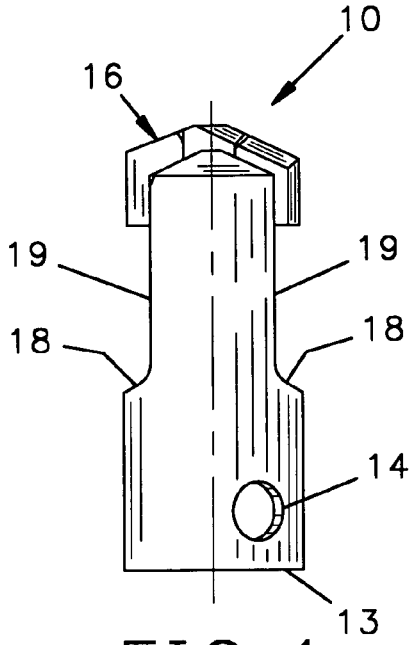
FIG.4 PRIOR ART
FIG. 4 is a side elevational view of the bit body shown in FIG. 2 with the blade shown in FIG. 1 attached thereto to form a drill bit in accordance with the prior art.

Referring specifically to FIGS. 1 and 2, a blade 16 in accordance with the prior art has first and second cutting sides 21, 22 which are symmetrical about the longitudinal axis 23. The first and second cutting sides 21, 22 have planar parallel opposing faces 24, 25. The rearward surface 26 of the blade 16 is generally planar and is adapted to fit at the bottom of the slot 15 of the bit body 12 with the planar faces 24, 25 thereof, received between the side walls of the slot 15.

The blade 20 further has parallel opposing outer end panels 27, 28 which are not perpendicular to the faces 24, 25, but are angled with respect thereto to create outer cutting edges 29, 30 and relief edges 31, 32. At the forward end of the blade are cutting surfaces 33, 34 which meet to form a forwardly directed apex 39. Like the outer end panels 27, 28, the cutting surfaces form an acute angle with the associated leading face to create cutting edges 35, 36 and trailing relief edges 37, 38.

When in use the drill bit 10 and blade 16 will be rotated about the axis 23 and the forward cutting edges 29, 30 will cut the hard material. Near the center of the blade, however, the rotating blade has lower surface speed and the cutting efficiency of the blade is reduced. The presence of a defined point at the center 39 of the blade has been found to reduce the cutting efficiency of the blade.

Where the drill bit 10 is used to bore into a stone ceiling of a mine, a hydraulic drilling machine applies great force to the lower end of the drill steel. A drill bit 10 having a tungsten carbide blade 20 that is subjected to the hydraulic forces of a drilling machine is capable of boring into stone or other hard materials. Where the drill rate of the drill bit 10 is too rapid, the forces applied to the blade 10 will cause it to fail after which the machine must be temporarily taken out of service and the drill bit 10 replaced.

Figure 5:
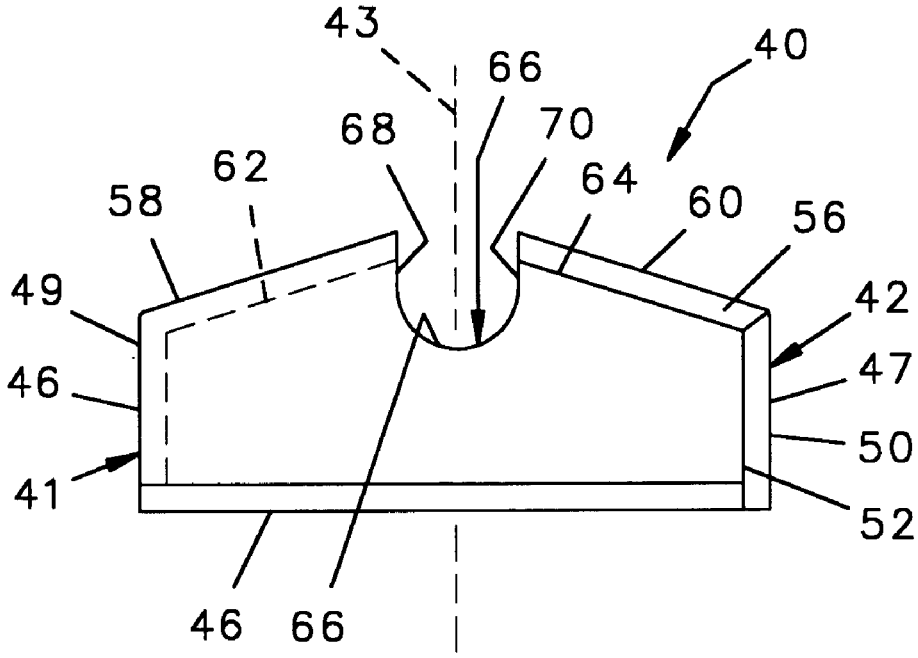
FIG.5 PRIOR ART
FIG. 5 is a side elevational view of a second embodiment of a blade in accordance with the prior art.
Figure 6:
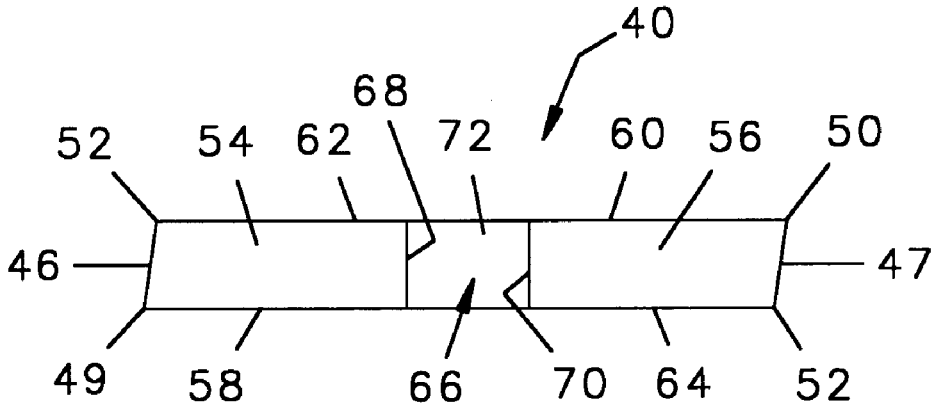
FIG.6 PRIOR ART
FIG. 6 is a top elevational view of the blade shown in FIG. 5.

Referring to FIGS. 5 and 6, a more efficient cutting blade 40 is also available in the prior art. Blade 40 has first and second cutting sides 41, 42 which are symmetric about a longitudinal axis 43. Blade 40 also has opposing planar faces 44, 45, a rearward surface 46, and outer end panels 47, 48 that form acute angles with the leading faces to form outer cutting edges 49, 50 and outer relief edges 51, 52. At the forward end of the blade are cutting surfaces 54, 56 which, like the outer end panels 47, 48 form acute angles with the leading faces to create leading cutting edges 58, 60 and trailing relief edges 62, 64. To increase the cutting efficiency of the, an axial notch 66 extends into the forward end thereof forming parallel walls 68, 70 and a semi-cylindrical bridge surface 72. the blade 40 is received a slot at the forward end of a bit body substantially as described above with respect to bit body 12.

There are certain problem arises to drill bits having blades 40 with longitudinal notches 66 therein. As the blade 40 rotates to bore into hard material the cutting edges 58, 60 remove small particles of the material from the outer portions of the bore. Hard material in the center of the bore, however, breaks off in chunks which may be too large to be drawn across the ramped surface 17 and between the planar surface 19 of the bit body 12 and the inner wall of the hole being drilled so as to be drawn by the vacuum. Such unbroken chunks will remain at the forward end of the blade and obstruct the movement of fines cut by the cutting edges 58, 60 and thereby reduce the efficiency at which the drill bit operates. Furthermore, where the blade 40 is made of a hard material such as tungsten carbide, the drilling process causes forces to build up and concentrate on the inner ends and on the outer ends of the cutting edges 58, 60 respectively. These forces will lead to the rapid deterioration of the cutting edges 58, 60 at their respective ends.

Referring to FIGS. 7 through 10, to overcome the problems caused in prior art blades, a new and improved blade 80 has first and second opposing cutting sides 82, 84 which are symmetrically about a longitudinal axis 86. Cutting side 82 has a leading face 88 and trailing face 89, and cutting side 84 has a leading face 90 and a trailing face 91.

The blade 80 further has parallel outer end panels 94, 96 which are not perpendicular to the faces 88–91 but are angled with respect thereto to form cutting edges 98, 100 and relief 102, 104. At the forward end of the blade 80 are cutting surfaces 106, 108 which like the cutting edges 98, 100 are not perpendicular to the faces 88–91 but are angled with respect thereto forming cutting edges 110, 112 and relief edges 114, 116. The blade 80 may further have a bulbous mid-portion 118 which is received in a complementary shaped notch at the forward end of the bit body to maintain alignment of the blade during the brazing operation and provides additional base strength.

Figure 8:
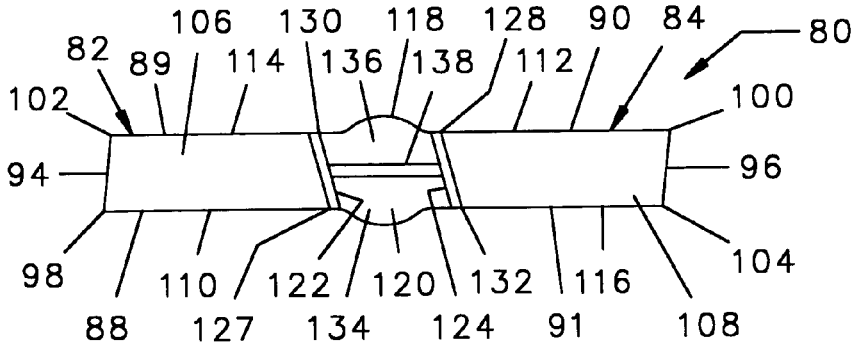
FIG. 8 is a front elevational view of the drill blade shown in FIG. 7.
Figure 7:
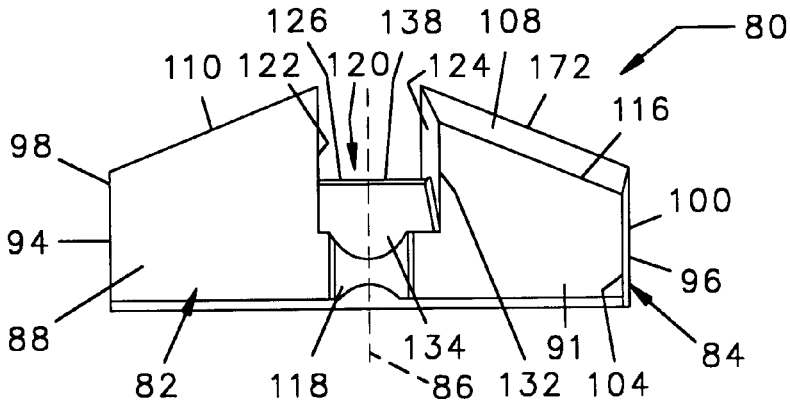
FIG. 7 is a side elevational view of a drill blade in accordance with the present invention.
Figure 9:
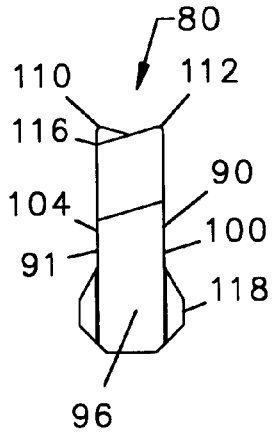
FIG. 9 is a side elevational view of the drill blade shown in FIG. 7.
Figure 10:
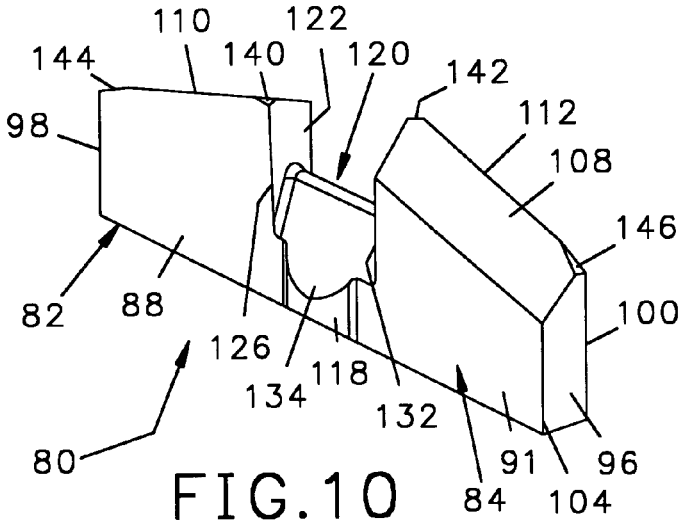
FIG. 10 is an enlarged isometric view of the drill blade shown in FIG. 7.
Figure 11:
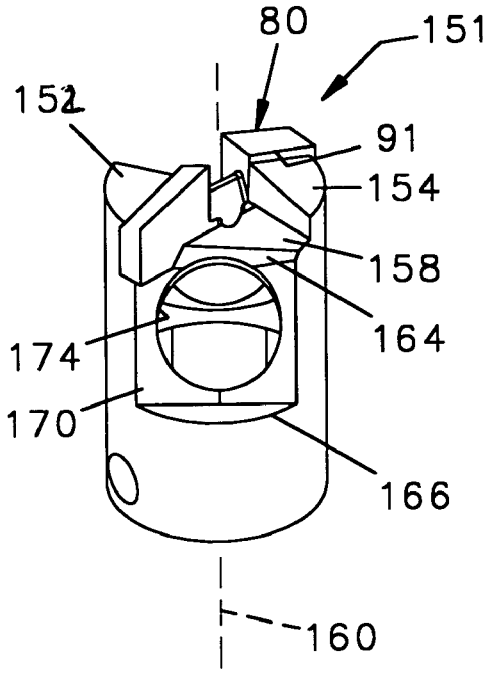
FIG. 11 is an isometric view of a drill bit consisting of the blade of FIG. 7 mounted on a bit body in accordance with the present invention.
Figure 12:
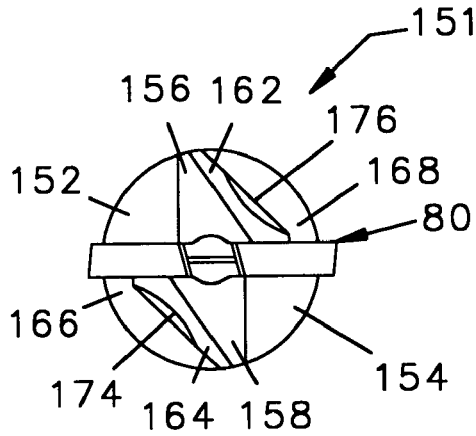
FIG. 12 is a front elevational view of the drill bit shown in FIG. 11.

Referring further to FIGS. 7, 8 and 10 the blade 80 has an axial slot 120 extending axially rearward from the forward end of the blade 80 defining parallel inner side walls 122, 124 and a transverse central bridge 126. In accordance with the present invention, the parallel inner side walls 122, 124 are not perpendicular to the faces 88, 90 but are angled with respect thereto to form inner cutting edges 127, 128 having and relief edges 130, 132. Cutting edge 127 is formed as a result of an acute angle between the leading face 88 and inner side wall 122 and cutting edge 128 is formed as a result of an acute angle between leading face 90 and inner side wall 124. Also, the bridge 126 is not planar, but instead has ramped surfaces 134, 136 which intersect in a centrally located cutting edge 138. It should be appreciated that while the cutting edge 138 is depicted as being linear and parallel to the faces 88, 90, the cutting edge 138 could be angled with respect to the faces 88, 90, or could be curved. Similarly, while the ramped surfaced 134, 136 are depicted as being planar, they may have any of a number of other configurations which taper to the cutting edge 138.

It will be appreciated that the inner cutting edges 127, 128 of the inner side walls 122, 124 and the centrally located cutting edge 138 will assist in the breakup of large particles broken loose near the central portion of the bore, thereby reducing their size and permitting them to be drawn away from the cutting blade by the vacuum drawn through the drill steel. The cutting edge 138 is formed in a die containing powdered metal and a binder compressed by a moveable punch and therefor the cutting edge 138 is not sharp to the touch. The cutting edge 138 has, in fact, a rounded edge with a radius to center of about 1/64 inch as needed depending on the cutting conditions.

As the drill blade rotates to cut into hard surfaces, high forces will concentrate at the ends of the cutting edges 110, 112 causing deterioration beginning at the ends thereof. To reduce such deterioration, the blade 80 further provides for inner relief surfaces 140, 142 and outer relief surfaces 144, 146. The inner relief surfaces 140, 142 have edges bordering on the adjacent leading faces 88, 90 respectively, the cutting surfaces 106, 108 respectively, and the inner side walls 122, 124 respectively. The outer relief surfaces 144, 146 have edges bordering on the leading faces 88, 90 respectively, the outer end panels 94, 96 respectively, and the cutting surfaces 106, 108. With the provision of inner and outer relief surfaces 140, 142, 144, 146 the distal ends of the cutting edges 110, 112 will not rapidly deteriorate as a result of internal forces, thereby extending the useful life of the blade 80.

Referring to FIGS. 11 through 14, in accordance with the invention, the blade 80 is fitted in a slot 148 at the forward end of a generally cylindrical bit body 150 to form a drill bit 151. The bit body 150 has a bore at the rearward end thereof, not shown, for attachment to the distal end of a drill steel, also not shown.

At the forward end of the bit body 150 are forwardly projecting wedge-shaped forward extensions 152, 154 adapted to provide support behind the relief faces 89, 91 of the blade 80 as it rotates. Adjacent the forward extensions 152, 154 and adjacent the mid-portions of the blade 80 are generally planar transverse tables 156, 158, the planes of which are substantially perpendicular to the axis 160 of the bit body 150.

The bit body 150 further has angled portions 162, 164 at the outer edges of the tables 156, 158 respectively and cut-out portions 166, 168 which extend along opposite sides of bit body 150 forming planar opposing surfaces 170, 172. The planar surfaces 170, 172 have apertures 174, 176 therein respectively, which communicate with the inner bore 178 of the bit body 150 to permit fines to be drawn by the vacuum away from the blade 80.

Figure 13:
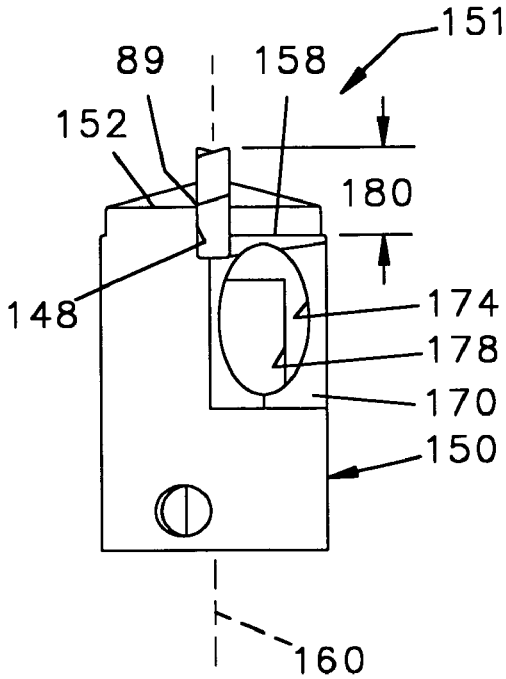
FIG. 13 is a side elevational view of the drill bit shown in FIG. 11.
Figure 14:
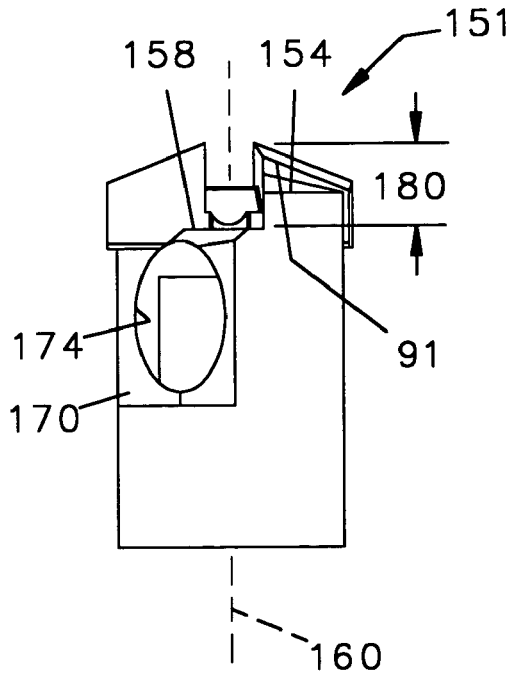
FIG. 14 is another side elevational view of the drill bit shown in FIG. 11 taken at 90 degrees with respect to the view shown in FIG. 11.

Referring to FIGS. 13 and 14, the tables 156, 158 are a distance 180 from the forward most cutting end 80. I have found that the provision of the tables 156, 158 causes particles of material cut by the blade 80 to accumulate on the table before dropping along the angled portions 162, 164 to the apertures 174, 176 and drawn down the central bore 178. The accumulation of particles on the tables 156, 158 reduces the rate at which the drill bit 151 bores into a surface, and therefore reduces the forces applied to the blade 80 during drilling. The reduction of forces on the blade 80 reduces blade failure. Blade failure will cause a drilling machine to be taken out of operation while the bit is replaced and will also result in replacement cost for the damaged drill bit. I have found that the drilling speed of the drill bit 151 can be reduced by increasing the sizes of the tables 156, 158, or by reducing the distance 180 such that the tables 156, 158 are nearer the forward end of the blade. Conversely, the drilling speed of a drill bit 151 can be increased by reducing the table sizes 156,158, or by increasing the distance 180 that the tables are spaced from the forward end of the blade 80.

Figure 15:
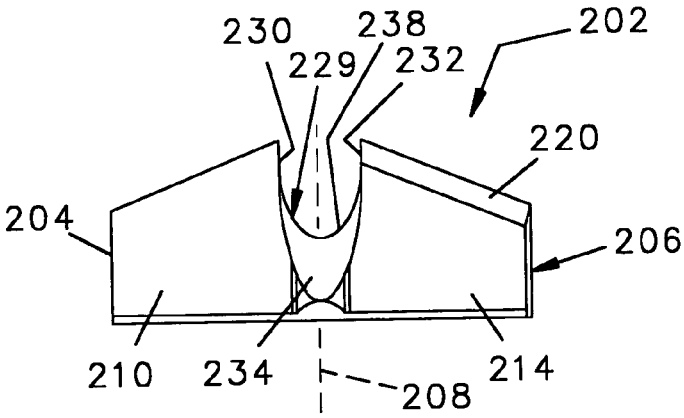
FIG. 15 is a side elevational view of a blade in accordance with a second embodiment of the invention.
Figure 16:
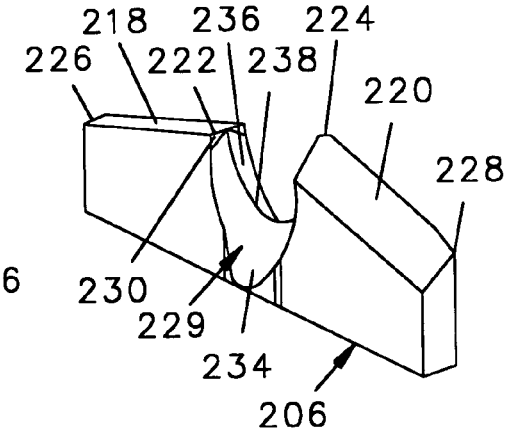
FIG. 16 is an isometric view of the blade shown in FIG. 15.
Figure 17:
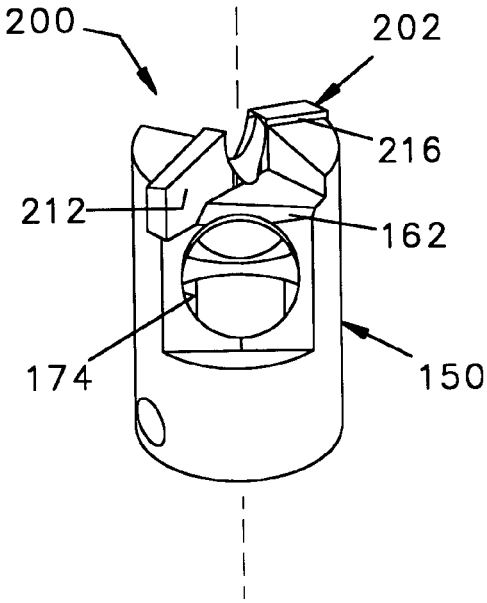
FIG. 17 is an isometric view of a drill bit in accordance with the present invention, incorporating a blade in accordance with FIG. 15.

Referring to FIGS. 15 through 17 in which a second embodiment of the invention is depicted, a drill bit 200 has a blade 202 attached to the bit body 150 previously described above. Blade 202 has cutting sides 204, 206, an axis 208, leading faces 210, 212 trailing faces 214, 216, and cutting surfaces 218, 220. Blade 202 also has inner relief panels 222, 224 and outer relief panels 226, 228.

Blade 202 differs from blade 80 in that blade 202 has a curved bridge 229 extending between the opposing parallel inner side walls 230, 232 creating a saddle configuration with sloping panels 234, 236 respectively to form a curved cutting edge 238. The curved cutting edge 238 of blade 202 breaks up large particles of hard material loosened from the center of the bore as the blade 202 continues its cut. By breaking up the large particles formed in the center of the bore, the particles are allowed to move across the angled portions 162, 164 of the bit body 150 to the apertures 174, 176 and be drawn by the vacuum through the central bore 178 of the drill bit 200.

Figure 18:
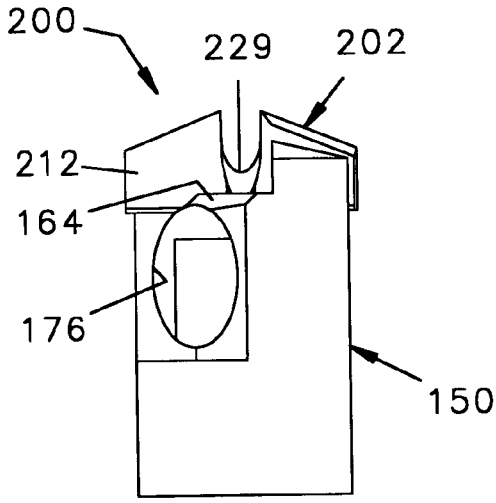
FIG. 18 is a side elevational view of the drill bit shown in FIG. 17.
Figure 19:
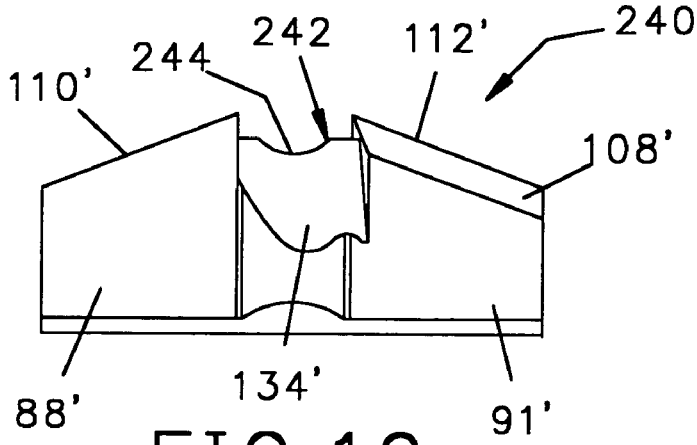
FIG. 19 is a side elevational view of a drill blade in accordance with a third embodiment of the invention.

A third embodiment of a blade 240 in accordance with the invention, depicted in FIGS. 17–19, is similar to blade 80 previously described. Most of the elements of blade 240 are identical to the corresponding elements of the blade 80 and where such identical correspondence exists the elements of blade 240 are not described in this text and are identified on the drawings with indicia numbers identical to the corresponding indicia numbers of the blade 80 except they are primed.

The shape of both blades 80 and 240 are formed by forming tungsten carbide particles with a wax binder in a die and compressing them with a punch. The formed part is then cintered. The bridge 242 of the blade 240 is rounded at the center 244 as shown.

Figure 20:
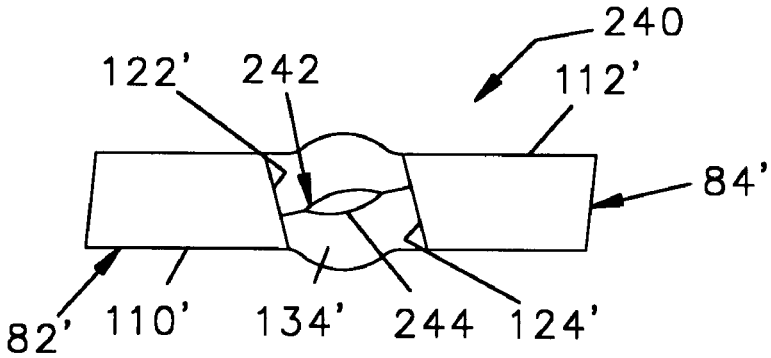
FIG. 20 is a front view of the drill blade shown in FIG. 19.
Figure 21:
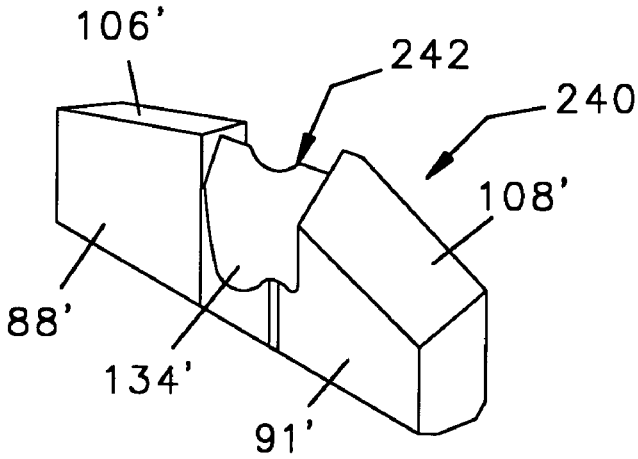
FIG. 21 is an isometric view of the drill blade shown in FIG. 19.
Figure 22:
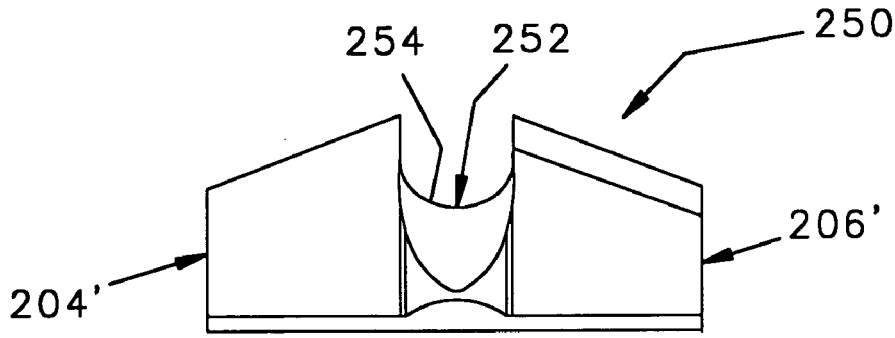
FIG. 22 is a side elevational view of a fourth embodiment of the invention.
Figure 23:
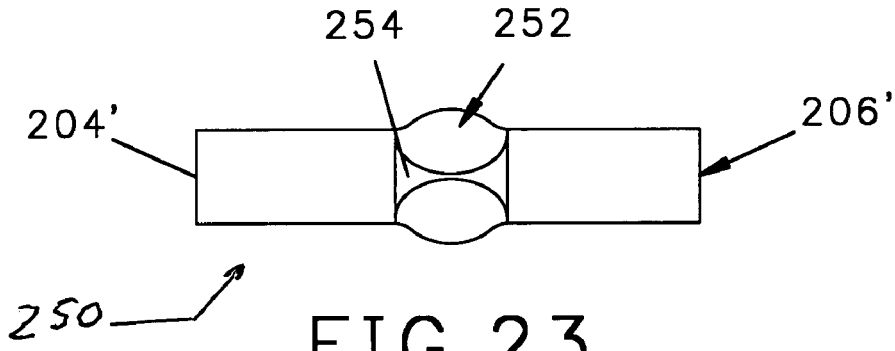
FIG. 23 is a front view of the drill blade shown in FIG. 22.
Figure 24:
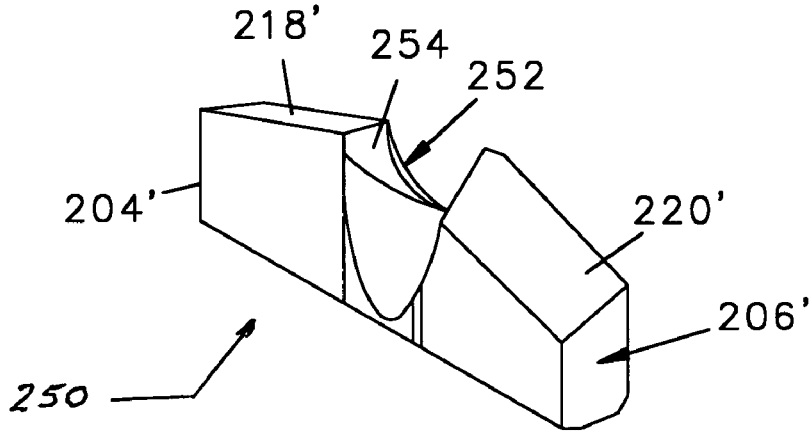
FIG. 24 is an isometric view of the drill blade shown in FIG. 22.

A fourth embodiment of a blade 250, depicted in FIGS. 20–22, is similar to blade 202 previously described and the elements of blade 250 which are identical to those of blade 202 are not described herein but bear indicia numbers on the drawings identical to those of blade 202 except they are primed. In this embodiment the bridge 252 of the blade 250 has again been rounded at its center 254.

While the present invention has been described with respect to several embodiments, it will be appreciated that many other modifications and variations may be made without departing from the spirit and scope of the invention. It is therefore the intent of the following claims to cover all modifications and variations of the present invention.

What is claimed:

1. A drill bit comprising an elongate bit body having a forward cutting end and a rearward mounting end, said rearward mounting end being tubular with an inner opening, said forward cutting end having a transverse slot for retaining a cutting blade, said forward cutting end having an aperture communicating with said inner opening, said forward cutting end having a table adjacent said slot and forward of said aperture for reducing a penetration rate of said drill bit, and a hardened blade retained in said transverse slot.

2. A drill bit in accordance with claim 1 and further comprising a second table adjacent said slot and opposite said first table.

3. A drill bit in accordance with claim 1 wherein said table is planar.

4. A drill bit in accordance with claim 3 wherein said planar table is perpendicular to an axis of rotation of said drill bit.

5. A drill bit comprising an elongate bit body having a forward cutting end and a mounting end, said cutting end having a transverse slot therein, a blade having a longitudinal axis, a cutting end and a mounting portion, said mounting portion retained in said slot in said bit body, said blade further having a longitudinal slot extending axially rearward from said cutting end, said slot defined by opposing side walls and a central bridge extending between said side walls, said bridge having a cutting edge extending between said walls and having first and second sides that slope away from said edges.

6. A drill bit in accordance with claim 5 wherein said cutting edge extends between said inner walls is linear.

7. A drill bit in accordance with claim 5 wherein said first and second sides that slope away from said edge are curved and said cutting edge extending between said inner walls is curved wherein said bridge has a saddle shape.

8. A drill bit comprising a bit body having a forward cutting end and a rearward mounting end, said cutting end having a transverse slot therein, a blade having a longitudinal axis, a cutting end, a mounting portion, a rearwardly extending axial slot, and having first and second opposing cutting sides, said first and second cutting sides positioned symmetrically about said longitudinal axis, said first and second cutting sides each having an inner wall surface wherein said first and second inner wall surfaces define walls of said axial slot, each cutting side having a leading face and a trailing face, said first cutting side having a forward cutting surface, said leading face for said first cutting side having a forward cutting edge at an intersection with said forward cutting surface and an inner edge at an intersection with said first inner wall, a stress relief surface having an edge along said leading face for said first cutting side, said first forward cutting surface and said first inner wall, and said blade received in said slot in said bit body.

9. A drill bit in accordance with claim 8 wherein said leading face and said trailing face of each of said cutting sides have outer edges and said blade further comprises an outer end surface extending between adjacent outer edges of said leading and trailing faces of said first side, and a second stress relief surface having an edge along said leading face for said first cutting side, said forward surface and said outer end surface.

10. A drill bit in accordance with claim 9 wherein said first inner wall forms a cutting edge with said intersection with said forward face from said first cutting side.

11. A drill bit in accordance with claim 10 wherein said cutting edge at said intersection of said forward face for said first cutting side and said first inner wall forms an acute angle.

12. A drill bit comprising a bit body having a forward cutting end and a rearward mounting end, said cutting end having a transverse slot therein, a blade having a longitudinal axis, a cutting end, a mounting portion, a rearwardly extending axial slot, and having first and second opposing cutting sides, said first and second cutting sides positioned symmetrically about said longitudinal axis, said first and second cutting sides each having an inner wall surface wherein said first and second inner wall surfaces define walls of said axial slot, each cutting side having a leading face and a trailing face, said first cutting side having a forward cutting surface, said leading face for said first cutting side having a forward cutting edge at an intersection with said forward cutting surface and an inner edge at an intersection with said first inner wall, said first inner wall forming a cutting edge at said intersection with said leading face of said first cutting end, and said blade received in said slot in said bit body.

13. A drill bit in accordance with claim 12 wherein said cutting edge at said intersection of said first inner wall and said leading face of said first cutting end forms an acute angle.

* * * * *